United States Patent [19]

Norlin

[11] 4,306,321

[45] Dec. 22, 1981

[54] BOAT AND CARAVAN CLOSET

[76] Inventor: Lars-Olof Norlin, Box 220, S-611 01 Nyköping, Sweden

[21] Appl. No.: 174,521

[22] PCT Filed: Mar. 23, 1979

[86] PCT No.: PCT/SE79/00065

§ 371 Date: Nov. 23, 1979

§ 102(e) Date: Nov. 23, 1979

[87] PCT Pub. No.: WO79/00826

PCT Pub. Date: Oct. 18, 1979

[30] Foreign Application Priority Data

Mar. 23, 1978 [SE] Sweden ..... 7803412

[51] Int. Cl.[3] ..... E03D 3/10; E03D 11/10

[52] U.S. Cl. ..... 4/321; 4/431; 4/433; 4/435

[58] Field of Search ..... 4/300, 316–323, 4/345, 346, 378–382, 353, 363–367, 354, 361, 362, 340–342, 387, 407, 420, DIG. 3, 431–436

[56] References Cited

U.S. PATENT DOCUMENTS

| | | | |
|---|---|---|---|
| 2,315,824 | 4/1943 | Sweeny | 4/435 X |
| 3,487,475 | 1/1970 | Minniear | 4/317 |
| 3,628,195 | 12/1971 | Skousgaard | 4/354 |
| 3,698,019 | 10/1972 | Culp | 4/435 X |
| 3,720,962 | 3/1973 | Harrat | 4/435 |
| 3,811,135 | 5/1974 | Drouhard et al. | 4/435 |
| 3,845,508 | 11/1974 | Oglesby | 4/407 |
| 3,965,492 | 6/1976 | Hendricks | 4/DIG. 3 |
| 3,996,628 | 12/1976 | Mollerstedt | 4/433 X |
| 4,170,048 | 10/1979 | Anthony | 4/434 |

FOREIGN PATENT DOCUMENTS 23540 10/1910 United Kingdom .

*Primary Examiner*—Stuart S. Levy

*Attorney, Agent, or Firm*—Witherspoon & Hargest

[57] ABSTRACT

The present invention refers to a closet combined with a sewage tank (7). The closet comprises a stand enclosing the sewage tank (7) and supporting a chair (1) composed of closet bowl (3), closet seat (4) and closet cover (5). A flushing water tank (18) is connected to the closet. The closet bowl (3) is adapted to be closed in a pressure-tight manner by means of the closet cover (5) and is provided with a discharge valve (8) opening at a predetermined overpressure in the closed closet bowl (3). Means (24, 25, 31) comprising an air-pump (24) are provided to empty the closet bowl (3). By means of the air-pump (24) and said means (25, 31) simultaneously both the closet bowl (3) and the flushing water tank (18) are placed under overpressure. A member (21) is provided to supply flushing liquid from the flushing water tank (18) to the closet bowl (3) when the discharge valve (8) in the closet bowl (3) has been opened and the overpressure therein has been reduced.

3 Claims, 4 Drawing Figures

BOAT AND CARAVAN CLOSET

FIELD OF THE INVENTION

The present invention refers to closets, in particular to a closet without permanent sewage connection and with a collecting tank intended to be used in boats, caravans and the like.

BACKGROUND

As far as closets for boats, caravans and the like are concerned, many problems must be faced. Such closets must be easily installed, stable and odourfree and it must be possible to empty such closets without risk of congestion in valves and conduits.

As far as trailer toilets are concerned, discharge is possible only at suitable collecting places, whereas boat toilets possibly may be discharged directly into the lake. This means that the emptying system of a boat toilet may be slightly more complicated than such a system for caravan toilets; it will be obvious, however, to an expert on the field, that only small alterations of a boat closet system will be required to adapt the system for use in larger vessels, such as floating houses. Accordingly, the following description will refer to a boat closet and the problems solved by the present invention in connection therewith.

Boat closets both with and without a collecting tank are well-known. In respect to rules expected to be issued regarding boat toilets, such rules presumably forbidding direct discharge into the lake, the sewage collecting tank will become a necessary part of the system. By the way, certain countries already forbid direct discharge of closet sewage into lakes.

Boat closets with discharge only into the lake for obvious reasons cannot be used in habours, beach bays and small waters. Because the majority of spare-time boats is used in "close-distance waters" of this type the closet in practice will never be usable.

In order that toilets of this type may be used to a greater extent they may be provided with sewage tanks. Such tanks, however, can only be discharged directly into the lake which means that closets having this type of tanks substantially has the same limited range of use as closets without a tank. However, there are certain portable tanks intended to be emptied ashore and requiring transport between the boat and the emptying place. Apart from the inconvenience caused by this procedure, the capacity will be limited to a great extent.

There are also closets adopted for discharged directly into the lake or ashore, a tank being provided for collecting the sewage between dumpings. In these closets the tank can be released for direct dumping into the lake after each use of the toilet. These known closet systems comprise complicated tubing and valves of a type subject to obstruction and malfunction.

A still more complicated system is the recycling system using a specific flushing liquid, normally some type of oil mixed with deodorants and bactericides such as formalin. While this flushing liquid is circulated in the system, the sewage is separated into a collecting container. However, it is difficult to achieve a simple and efficient separation and to avoid unpleasant odour emanating from the circulating flushing liquid. In systems without circulation it is a general problem to keep the flushing water consumption at a minimum. Another problem resides in the lack of available closet systems suitable for most boats and caravans, which means that closet arrangements must be specifically ordered for each type of use.

It is the purpose of the present invention to eliminate or at least minimize the above-explained draw-backs. This purpose is achieved by means of a closet of the type indicated in the claims which also state the specific characteristic features of the invention.

DETAILED DESCRIPTION OF PREFERRED EMBODIMENTS

Figure 1:
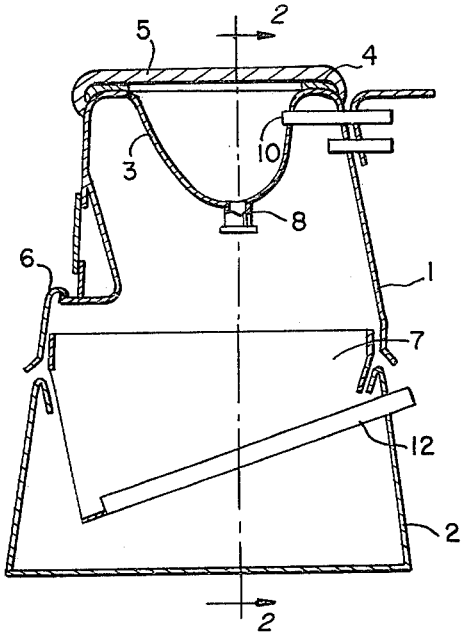
FIG. 1 is a schematical section of a closet chair comprising a tank in accordance with the invention.
Figure 2:
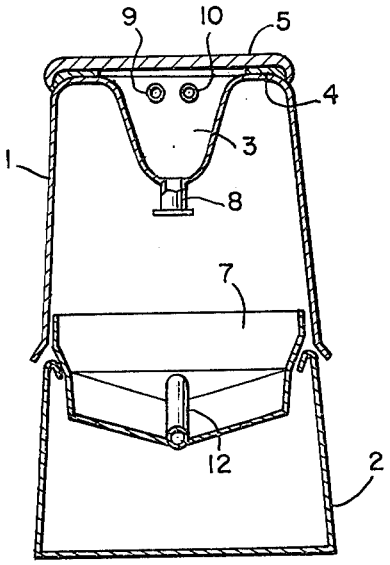
FIG. 2 is a section along line 2—2 in FIG. 1.
Figure 3:
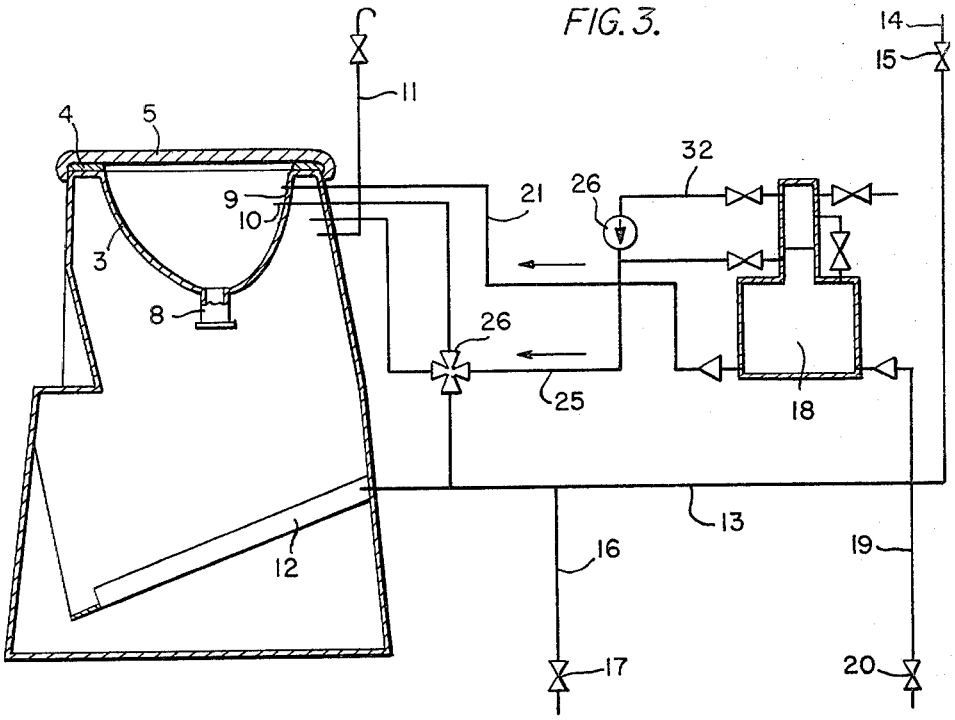
FIG. 3 schematically illustrates the conduit system of closets according to the invention.

The toilet chair 1 is supported by a stand 2 intended to be secured to the floor board of the boat. At the outer end chair 1 is provided with a closet bowl 3 having a seat 4 and a cover 5. For reasons of convenience chair 1 at the front side and in a suitable elevation in relation to the seat 4 is provided with a foot rest 6. The cover 5 can be closed in a pressure-tight manner unto the closet bowl 3.

A collecting tank 7 is inserted into stand 2. In the bottom of the closet bowl 3 a valved outlet 8 is provided which in an odour free manner separates tank 7 from the bowl 3 proper. Moreover inlet 9, 10 for respectively flushing water and air are provided in bowl 3. Moreover a valved venting tube 11 is connected to bowl 3.

The chair, tank and stand are suitably made of non-corrosive material such as glass-fibre reinforced plastic. It is particularly suitable that at least stand 2 is made of glass-fibre reinforced plastic because this material can easily be adopted to the shape of the boat hull or board and may be plastically attached thereto. In the embodiment shown the tank has a volume of about 80 liters which corresponds to a capacity sufficient for four persons during 5 days use without dumping. A suitable size of bowl 3 is about 8 liters.

In the embodiment shown the chair 1 is shaped as a box of rectangular cross-section having three outwardly slightly inclined sides. The forward side is in part inwardly inclined to produce the foot support 6. This foot support 6 is positioned about 35 cm below the seat to permit a comfortable sitting position. Chair 1 is detachably placed upon stand 2 to permit access to the interior of the closet such as for cleaning purposes.

The sewage tank 7 has rectangular cross-section and sides which are slightly inwardly inclined in relation to the bottom. The bottom is preferably slightly V-shaped and strongly inclined towards the front side of the closet whereby positioning against for example an inclined boat bottom is facilitated. Within the bottom angle a discharge tube 12 is inserted having its lower end opening near the lowest point of tank 7 and the other end detachably connected to the emptying system.

Also stand 2 is of rectangular cross-section and has outwardly inclined sides. Its upper part has an inwardly folded edge in conformity both the sewage tank 7 and a flange provided at the lower edge of closet chair 1.

The discharge tube 12 in tank 7 is connected to a discharge conduit 13 leading to a suction discharge connection 14 provided with a closing valve 15. A conduit 16 branch from discharge conduit 13 opens via closing valve 17 into the lake.

For flushing the closet bowl 3 a flushing water container 18 is provided receiving lake water through a conduit 19 with valve 20 and discharging water via a conduit 21 and inlet 9 into bowl 3. In the flushing water container 18 inlet conduit 19 is provided with a check-valve 22 preventing water from flowing back from container 18 to the lake, and outlet conduit 21 is provided with a check valve 23 preventing flushing water from flowing back from a closet bowl 3 to container 18.

The pressure side of an air-pump 24 is connected via a conduit 25 to a change-over valve 26 from which compressed air alternatively can be directed to inlet 10 in closet bowl 3, to the space where sewage tank 7 is positioned and to discharge conduit 13 at a position between the discharge tube 12 and the branch tube 16.

Figure 4:
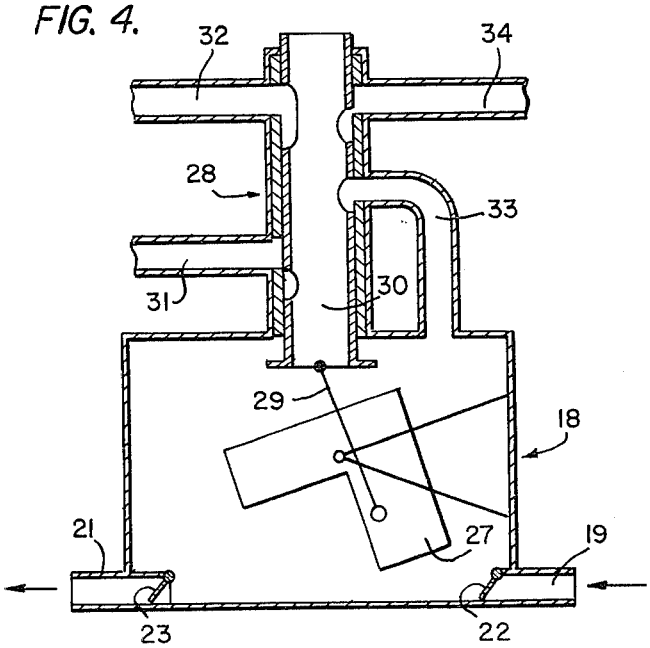
FIG. 4 is a schematic partial section of the flushing water container and its control valve.

A float 27 provided within the flushing water container 18 controls a multiple port valve 28. In the embodiment shown in FIG. 4 the float 27 by means of a link 29 actuates a valve slide 30. From the pressure side of pump 24 a conduit 31 is connected to valve 28 and from the suction side of pump 24 a conduit 32 is connected to valve 28. Moreover, a conduit 33 extends from the flushing water container 18 proper to valve 28 and a conduit 34 extending from valve 28 is connected to an air inlet.

By means of valve 28 the flushing water container 18 can be placed under positive and negative pressure, respectively. When it is exposed to over-pressure, pump 24 sucks air through conduits 32 and 34 and when it is exposed to negative pressure pump 24 sucks air from container 18 while pressure conduit 31 then is closed. Pump 24 may be hand or motor driven.

In the embodiment of the invention shown at least the valves are manually operated. However, the valves may be parts of a hydraulic, pneumatic or electric control system or a combined system without deviation from the basic inventive idea. The check valves 22, 23 in the flushing water container 18 suitably are of automatic type.

The closet system operates in the following way:

After use closet cover 5 is closed and fixed in the closed position by means not shown. The change-over valve 26 is then positioned so that the pressure side of pump 24 is connected to the closet bowl 3. The closing valve 20 for the lake-water intake to the flushing water container 18 is open and due to the fact that the flushing water container 18 is empty valve 28 is in the position shown in FIG. 4 which means that the suction conduit 32 to pump 24 is connected to container 18 through conduit 33 and the pressure conduit 31 leading to container 18 is closed.

Emptying and flushing of bowl 3 is performed by pumping and without particular operating measures and in one successive action. Pumping may be performed manually or with the aid of a motor.

Pump 24 supplies air to closet bowl 3 and at the same time sucks air from the flushing water container 18 which by means of conduit 19 is in communication with the lake. Due to the negative pressure water is sucked into container 18 and when the water level there has risen to a certain elevation float 27 is actuated and in turn via link 29 shifts valve slide 30 to its upper position. With the aid of a handle not shown float 27 may be held in the lower position until the level in the container has risen above the normal adjusted level whereby a more than normal amount of flushing water can be obtained. Due to the fact that the flushing water container is transparent the water level there can conveniently be observed.

During all the time pump 24 supplies compressed air to the closet bowl 3 and when a sufficient pressure has been built-up there to overcome the resistance of the pressure controlled bottom valve 8 this valve will open and permit the sewage to be blown down into the sewage tank 7. While the pressure is built up in closet bowl 3 and valve 28 is shifted from the position shown in FIG. 4 to the position in which the valve slide is in its uppermost position, compressed air will be supplied to the flushing water tank 18 through conduit 31. The flushing water is then exposed to pressure and is forced out through valve 23 and conduit 21 into and through inlet 9 in closest bowl 3. The water will then rinse bowl 3 and will be forced out through bottom valve 8 into sewage tank 7. At the same time the pump sucks free air through conduits 34 and 32. When the pressure in bowl 3 has gone down the bottom valve 8 will close while water continuously is supplied from flushing water container 18 until this container has been emptied.

Pumping is continued during and after the blow-out of sewage from bowl 3 into sewage tank 7. Float 27 does not exert a downward pulling action on valve slide 30 when the water level in container 18 has gone down because the over-pressure created therein due to the continued pumping action acts upon valve slide 30 and retains it in the upper position.

During emptying of closet bowl 3 the pressure therein has gone down to atmospheric pressure and valve 8 has been closed but due to the continued pumping action pressure will again rise therein and when the pressure threshold has been reached the bottom valve 8 of bowl 3 will open and the water contained in the bowl will be quickly blown down into the sewage tank thereby creating a powerfull rinsing action in the lower part of the bowl and through valve 8. This eliminates any risk that matter will be retained in valve 8 and prevent it from closing correctly.

When the sewage tank 7 is to be emptied to the lake valve 26 is adjusted to the position in which the compressed air from pump 24 is supplied to the space between the lower surface of bowl 3 and sewage tank 7. The valve in the venting tube 11 is closed and the closing valve 17 is opened. Valve slide 30 is held in its upper position and pumping is started.

After some pump strokes the actuation of the valve slide can cease because the over-pressure in the flushing container 18 retains the slide in its upper position. Pump 24 now sucks air through conduits 32 and 34 and forces this air into sewage tank 7 from which the sewage is discharged due to the positive pressure through conduits 13 and 16 into the lake.

Ashore the sewage tank 7 is emptied by sucking action. Sucking is then performed through conduit 13, valve 26 then being adjusted to prevent compressed air to be supplied to conduit 13 and valve 17 is closed. On the other hand the valve of venting tube 11 is suitably open to avoid a subatmospheric pressure in sewage tank 7. The suction hose is then attached to connection 14 and valve 15 is opened permitting suctional discharge of the sewage from tank 7 to be performed.

If outlet tube 12 is obstructed it is possible to perform a back-blowing action by creating a state of pressure in the tube. Valve 26 in this case is adjusted to a position in which compressed air from pump 24 is introduced into conduit 13 and valves 15 and 17 are held closed. Valve slide 13 is held in its upper position and pumping is performed. Pressure is then built-up in conduit 13 and will push back any sewage plugging discharge tube 12 into the sewage tank 7.

The present invention thus provides a toilet without permanent discharge connection which is not subject to the above-described drawbacks observed at prior-art toilets of a similar type. Moreover, additional advantages have been obtained such as simple and easily operated construction of great durability and comfort in use. The closet is easily adopted to various forms of use such as in caravans, boats and the like, and it is easily mounted in narrow spaces and on inclined bottom surfaces.

I claim:

1. Closet with sewage tank (7) comprising a stand enclosing the sewage tank (7) and supporting a chair (1) having a closet bowl (3), a closet seat (4) and a closet cover (5), and having a flushing water container (18), and said closet bowl (3) being adapted to be closed in a pressure-tight manner by means of the cover (5), said bowl also being provided with a discharge valve (8) which opens at a predetermined overpressure in the closet bowl (3), closet bowl (3) and sewage tank (7) communicating through such discharge valve opening, characterized in that for emptying the closet bowl (3) into the sewage tank (7) means (24, 25, 31) comprising an air pump (24) are provided acting simultaneously to expose both the closet bowl (3) and the flushing water container (18) to over-pressure, said over-pressure continuing to a predetermined amount in the closet (3) to force open the discharge valve (8), and that means (21) are provided supplying flushing liquid from the flushing water container (18) to the closet bowl (3) through the discharge valve opening and into the sewage tank (7) when the discharge valve (8) in the closet bowl (3) has been so opened.

2. Closet as claimed in claim 1, characterized in that the means provided to expose both the closet bowl and the flushing water container for over-pressure comprise a conduit (25) leading from the air pump (24) to the closet bowl (3) and a conduit (31) leading from the air pump (24) to the flushing water container (18) and said air pump (24).

3. Closet as claimed in claim 1 or 2 wherein the discharge valve (8) is a pressure controlled valve wherein subsequent to said opening of the discharge valve (8) the discharge valve (8) is closed when the pressure in the closet bowl (3) has decreased to a predetermined amount, wherein means are provided to continue to supply additional flushing liquid to the closet bowl (3) after the discharge valve (8) is so closed, and wherein means are also provided to expose closet bowl (3) to additional pressure after the discharge valve (8) is so closed, said additional pressure continuing to a predetermined amount in the closet bowl (3) to again force open the discharge valve (8) and blow said additional flushing liquid through the discharge valve opening and into the sewage tank (7).

* * * * *